US009386636B2

(12) United States Patent
Van Delden

(10) Patent No.: US 9,386,636 B2
(45) Date of Patent: Jul. 5, 2016

(54) LIGHTING DEVICE WITH TETRAHEDRAL OPTO-ELECTRONIC MODULES

(71) Applicant: KONINKLIJKE PHILIPS N.V., Eindhoven (NL)

(72) Inventor: Martinus Hermanus Wilhelmus Maria Van Delden, Venlo (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/423,808

(22) PCT Filed: Aug. 22, 2013

(86) PCT No.: PCT/IB2013/056811

§ 371 (c)(1),
(2) Date: Feb. 25, 2015

(87) PCT Pub. No.: WO2014/033598

PCT Pub. Date: Mar. 6, 2014

(65) Prior Publication Data

US 2015/0230297 A1 Aug. 13, 2015

Related U.S. Application Data

(60) Provisional application No. 61/693,386, filed on Aug. 27, 2012.

(51) Int. Cl.
*H05B 33/06* (2006.01)
*F21S 8/00* (2006.01)
(Continued)

(52) U.S. Cl.
CPC *H05B 33/06* (2013.01); *E04B 9/32* (2013.01); *F21S 8/00* (2013.01); *F21S 8/03* (2013.01); *H05B 33/10* (2013.01); *F21S 2/00* (2013.01); *F21W 2131/402* (2013.01); *F21Y 2101/02* (2013.01); *F21Y 2111/007* (2013.01)

(58) Field of Classification Search
CPC .... H05B 33/06; H05B 33/10; F21Y 2101/02; F21Y 2111/006
See application file for complete search history.

(56) References Cited

U.S. PATENT DOCUMENTS 6,891,200 B2 * 5/2005 Nagai ..... F21K 9/90 257/100
8,646,943 B2 * 2/2014 Wan ..... F21V 19/001 362/249.02
2010/0264799 A1 * 10/2010 Liu ..... F21V 29/006 313/46
2011/0038152 A1 2/2011 Kuegler
2012/0155084 A1 6/2012 Hsueh et al.

FOREIGN PATENT DOCUMENTS

DE 102007043904 A1 3/2009
GB 2479758 A 10/2011
(Continued)

*Primary Examiner* — Robert May

(57) ABSTRACT

The present invention relates to a lighting device (1) comprising: a carrier (106, 206, 306), an electrode pattern comprising at least a first carrier electrode (214, 312) arranged on the carrier, and an opto-electronic module (102, 202, 302, 402). The opto-electronic module (102, 202, 302, 402) comprises: a first, a second, a third and a fourth electric contact point arranged to together define a tetrahedron; a first light source (208, 308, 408) arranged to emit light in response to an AC-voltage being applied between the first electric contact point (216, 316, 416) and the second electric contact point (218, 318, 418); and a second light source (210, 310, 410) arranged to emit light in response to an AC-voltage being applied between the third electric contact point (220, 320, 420) and the fourth electric contact point (222, 322, 422). The electrode pattern is configured to allow provision of an AC-voltage between the first electric contact point (216, 316, 416) and the second electric contact point (218, 318, 418) or between the third electric contact point (220, 320, 420) and the fourth electric contact point (222, 322, 422) of the opto-electronic module (102, 202, 302, 402).

15 Claims, 3 Drawing Sheets

(51) Int. Cl.

| | |
|---|---|
| ***E04B 9/32*** | (2006.01) |
| ***H05B 33/10*** | (2006.01) |
| *F21Y 101/02* | (2006.01) |
| *F21Y 111/00* | (2016.01) |
| *F21S 2/00* | (2016.01) |
| *F21W 131/402* | (2006.01) |

(56) References Cited

FOREIGN PATENT DOCUMENTS

| | | | |
|---|---|---|---|
| WO | 2008099306 | A1 | 8/2008 |
| WO | 2010128440 | A1 | 11/2010 |
| WO | 2011156994 | A1 | 12/2011 |

* cited by examiner

LIGHTING DEVICE WITH TETRAHEDRAL OPTO-ELECTRONIC MODULES

CROSS-REFERENCE TO PRIOR APPLICATIONS

This application is the U.S. National Phase application under 35 U.S.C. §371 of International Application No. PCT/IB13/056811, filed on Aug. 22, 2013, which claims the benefit of U.S. Provisional Patent Application No. 61/693,386, filed on Aug. 27, 2012. These applications are hereby incorporated by reference herein.

FIELD OF THE INVENTION

The present invention generally relates to a lighting device and to a method for manufacturing a lighting device.

BACKGROUND OF THE INVENTION

Conventional lighting arrangements and light sources have been developed and improved during years of research and development. Recently, interest has increased regarding lighting arrangements for large surfaces such as a part of a wall, a ceiling or a floor. However, with the existing production methods being adapted for producing conventional lighting arrangement, it is challenging to manufacture a lighting device for large surfaces cost effectively. For example conventional pick-and-place technology has technical limitations in terms of capacity, efficiency and surface area.

SUMMARY OF THE INVENTION

In view of the above-mentioned and other drawbacks of the prior art, a general object of the present invention is to provide an improved lighting device combining potential for efficient production with the potential for low cost solutions.

According to a first aspect of the present invention there is provided a lighting device, comprising: a carrier, an electrode pattern comprising at least a first carrier electrode arranged on the carrier, and an opto-electronic module, the opto-electronic module comprising: a first, a second, a third and a fourth electric contact point arranged to together define a tetrahedron, a first light source arranged to emit light in response to an AC-voltage being applied between the first electric contact point and the second electric contact point, and a second light source arranged to emit light in response to an AC-voltage being applied between the third electric contact point and the fourth electric contact point, wherein the electrode pattern is configured to allow provision of an AC-voltage between the first electric contact point and the second electric contact point or between the third electric contact point and the fourth electric contact point of the opto-electronic module.

The present invention is based on the realization that a lighting device especially adapted for large area lighting can be achieved by arranging three-dimensional opto-electronic modules on a carrier. The three-dimensional modules can be easily dispersed across a surface. The module is extended in 3 directions to facilitate different orientations of the opto-electronic module. A height, a width and a length of the opto-electronic module enables the opto-electronic module to be, for example, sandwiched between two electrodes or arranged on in-plane electrodes. The present inventor has further realized that by forming the opto-electronic module as a tetrahedron, high stability for every orientation is achieved. In the context of this invention, the term "tetrahedron" refers to any polyhedron composed of four not necessarily identical triangular faces, three of which meet at each vertex (or corner point) of the polyhedron, and it includes both regular and non-regular tetrahedra. Regardless of orientation, the base of the tetrahedron-shaped opto-electronic module rests on the carrier surface supported by three out of totally four electric contact points. The structure of three electric contact points resting on a surface renders the opto-electronic module less sensitive to imperfections is carrier flatness. Furthermore, arranging the electric contact points in the corners of the opto-electronic module ensures that as much light as possible may be emitted.

The light sources within the opto-electronic module are arranged to emit light regardless of the orientation of the tetrahedron-shaped opto-electronic module, i.e. the configuration of the light sources is indifferent to which of the faces of the tetrahedron that is the base, when driven with AC-voltage. The opto-electronic module is arranged to emit light regardless of the orientation of the opto-electronic module, by arranging the first light source to emit light when AC-voltage is applied between the first and the second electric contact points and by arranging the second light source to emit light when AC-voltage is being applied between the third and the fourth electric contact point.

In the case where two light sources are arranged in the opto-electronic module, at least one of the light sources is configured to emit light when the lighting device is driven with AC-voltage.

According to one embodiment of the invention, the lighting device may further comprise a plurality of opto-electronic modules.

An advantage with this embodiment is that several opto-electronic modules increases the light output and that several opto-electronic modules arranged across a carrier enables a cost-efficient lighting device adapted for relatively large areas. An advantage with a plurality of opto-electronic module is that when arranged on a surface the opto-electronic modules have the same height which facilitates applications where the opto-electronic modules are sandwiched between an electrode pattern.

According to one embodiment of the invention, the first light source may have a first terminal connected to the first electric contact point and a second terminal connected to the second electric contact point and the second light source may have a first terminal connected to the third electric contact point and a second terminal connected to the fourth electric contact point.

Regardless of how the opto-electronic module is arranged, the above-described configuration of the light sources comprised in the opto-electronic module ensures that at least one light source may emit light for a variety of electrode arrangements. By connecting each of the terminals of the first and second light sources to separate electric contact points, one of the first and the second light source is always arranged parallel to the carrier, regardless of the orientation of the opto-electronic module, while the other light source is always arranged between an electric contact point on the base of the opto-electronic module and the single top electric contact point of the opto-electronic module, thus extending vertically inside the opto-electronic module.

According to one embodiment of the invention, the lighting device may further comprise a cover sheet, the opto-electronic module being sandwiched between the carrier and the cover sheet.

The cover sheet may be transparent or translucent. Alternatively, the cover sheet may combine opaque and translucent regions to form an illumination pattern. The cover sheet may also include a diffuser or a filter, such as a colored filter covering the opto-electronic module. The cover sheet may comprise a wavelength converting material to adjust the wavelength emitted by the light sources.

According to one embodiment of the invention, the electrode pattern may comprise a cover sheet electrode arranged on the cover sheet, the cover sheet electrode being in electrical contact with one of the first, second, third and fourth contact point of the opto-electronic module.

The opto-electronic module may be sandwiched between the cover electrode and the first carrier electrode such that a potential difference may be applied at least between the first electric contact point and the second electric contact point or the third electric contact point and the fourth electric contact point. By sandwiching the opto-electronic module between the carrier electrode and the cover sheet electrode, all the electric contact points of the opto-electronic module is arranged to be in electrical contact with the electrode pattern.

According to one embodiment of the invention, three of the first electric contact point, the second electric contact point, the third electric contact point and the fourth electric contact point may be in connection with the first carrier electrode and one of the first electric contact point, the second electric contact point, the third electric contact point and the fourth electric contact point may be in connection with the cover sheet electrode.

When the opto-electronic module is sandwiched between two electrodes, the single top electric contact point of the opto-electronic module renders it especially forgiving for unevenness in the cover sheet electrode.

According to one embodiment of the invention, each of the first light-source and the second light-source may comprise an anode and a cathode, and the opto-electronic module may further comprise a third light source and a fourth light-source, each comprising an anode and a cathode, wherein the anode of the first light source may be connected to the first electric contact point, the cathode of the second light source may be connected to the third electric contact point, the cathode of the third light source may be connected to the second electric contact point, the anode of the fourth light source may be connected to the fourth electric contact point and the cathode of the first light source, the anode of the second light-source, the anode of the third light source, and the cathode of the fourth light source may be connected to each other.

An effect of this embodiment is that, when AC-voltage is applied between one of the electric contact points and the remaining three contact points, three out of four light sources are arranged to generate light. To enable three out of four light sources to generate light, three electric contact points experience the same potential and sign while the remaining electric contact point has the opposite sign. Some light sources are arranged to only operate under forward bias conditions, such as solid state light sources. Forward bias conditions for a light source should be understood as a potential drop over the light source from the anode to the cathode. During forward bias conditions, a light source is able to transmit current and generate light. When a potential difference is applied between the electrodes, three of the four light sources are in forward bias and can emit light. However, one out of four light sources may not emit light for any potential.

Furthermore, for the three light sources generating light, one may be overdriven such that twice the current is transmitted through one light source while the remaining two light sources divide the current between each other. The overdriven light source may deliver the same amount of light as the other two functional light sources put together.

According to one embodiment of the invention, the electrode pattern may further comprise a second carrier electrode arranged on the carrier.

The lighting device may have a first and a second carrier electrode in the same plane to enable light to be generated from the opto-electronic module when one electric contact point is connected to the first carrier electrode while another electric contact point is connected to the second carrier electrode, such that at least an AC-voltage is applied between the first and the second electric contact points or an AC-voltage is being applied between the third and the fourth electric contact point. For the electrode arrangement where two electrodes are arranged in the same plane only three out of four electric contact points may connect with the electrodes on the carrier.

According to one embodiment of the invention, the opto-electronic module may further comprise a diffuser material arranged within the tetrahedron defined by the first electric contact point, the second electric contact point, the third electric contact point and the fourth electric contact point to scatter light emitted by the light sources.

A transparent material such as crystal clear silicone may be mixed with a highly scattering material, such as $TiO_2$, to diffuse the emitted light. Alternatively or in combination, the tetrahedron may include a wavelength converting material such as phosphor. The tetrahedron may be coated with a layer of phosphor such that when blue light is emitted the phosphor layer may convert the light towards longer wavelengths such that the opto-electronic module appears to emit white light.

According to one embodiment of the invention, the lighting device may further comprise a sound absorbing material.

The sound absorbing material may include any one of conductive foams, steel wool and metal curls. Sound absorbing cavities may be arranged in the opto-electronic module or in a cover sheet arranged over the opto-electronic module. Conventional sound absorbing tiles, foams, insulators may be deployed in the cover sheet. The lighting devices that comprise a sound absorbing material may be implemented in tiles, walls and ceilings for public areas to improve both the lighting and the sound environment.

According to one embodiment of the invention, each of said light sources is a solid state light source.

A solid state light-source is light source in which light is generated through recombination of electrons and holes. Examples of solid state light sources include light emitting diodes and semiconductor lasers. The light sources may also be adapted to emit colored light. The color of the light emitted by the solid state light sources depends on the energy gap of the semiconductor material.

According to one embodiment of the invention, the opto-electronic module may further comprise at least one regular diode.

The regular diodes are diodes that do not emit light, e.g. a semiconductor diode and a zener diode. Diodes allow current to pass in a forward direction of the diode while blocking current in the reverse direction. However, the zener diode allows current to flow in both the forward and the reverse direction. For the zener diode, the breakdown voltage is the value of the voltage when the current may flow in the reverse direction.

Solid state light sources of different colors have different threshold voltages, due to different energy gaps in the semiconductor material. The threshold voltage indicates the voltage that needs to be applied in order for the solid state light source to generate light. By combining solid state light sources of different colors in series with at least one diode, the opto-electronic module may be configured to emit a plurality of colors. A diode, such as a semiconductor diode or a zener diode, may be connected in series to a solid state light source such that the diode together with the solid state light source matches another forward threshold voltage of a different solid state light source enabling both light sources to emit light. By combining one or several diodes with the light sources, it enables that one voltage may be applied over the opto-electronic module such that it complies with the different forward threshold voltages of the differently colored solid state light sources. An advantage of zener-diodes is that they come in a variety of threshold voltages. However, semiconductor diodes may also be utilized, such as a silicon diode with a forward threshold voltage of ~0.7 V or a Germanium diode with a forward threshold voltage of 0.3V.

According to one embodiment of the invention, the electrode pattern may comprise at least one of a resistive electrode, a transparent electrode and a reflective opaque electrode.

The electrode pattern may comprise a transparent electrode to let light through from the opto-electronic modules. An example of a transparent electrode is an ITO (Indium-Tin-Oxide) electrode. Furthermore, the thickness of the ITO affects the material conductivity, for increasing the concentration of charge carriers the thickness of the material can be increased. The electrode pattern may include a resistive electrode, for example the first carrier electrode may be a resistive electrode. If the voltage drop across a length of the electrode matches the length between two electric contact points and the operational voltage of the tetrahedron a single and unpatterned electrode may be employed. The electrode pattern may include a reflective opaque electrode to reflect light emitted by the light sources out towards the surroundings.

According to a second aspect of the present invention, there is provided a method of manufacturing a lighting device comprising the steps of:

providing a carrier, arranging at least one opto-electronic module on the carrier, the opto-electronic module comprising: a first, a second, a third and a fourth electric contact point arranged to together define a tetrahedron; a first light source arranged to emit light in response to an AC-voltage being applied between the first electric contact point and the second electric contact point; and a second light source arranged to emit light in response to an AC-voltage being applied between the third electric contact point and the fourth electric contact point; and connecting the at least one opto-electronic module to an electrode pattern being configured to allow application of an AC-voltage between the first electric contact point and the second electric contact point or between the third electric contact point and the fourth electric contact point.

The lighting device for large area illumination is easily manufactured since a plurality of opto-electronic modules may be efficiently placed over a relatively large area in a single operational step. The single operational step may be an in-line production process e.g. a roll-2-roll or a roll-2-sheet. The lighting device may be manufactured by sandwiching the opto-electronic module between a first carrier electrode and a cover sheet electrode or by connecting an opto-electronic module to a first carrier electrode and a second carrier electrode in the same plane. Furthermore, the opto-electronic module may also be arranged on a resistive electrode with a potential drop between at least the first electric contact point and the second electric contact point or the third electric contact point and the fourth electric contact point such that at least one of the light source may emit light.

According to an embodiment of the invention, the method further comprises the step of sandwiching the at least one opto-electronic module between said carrier and a cover sheet.

On the cover sheet, a cover sheet electrode may be arranged with at least one contact pad arranged for electrical connection with at least one electric contact point of the opto-electronic module(s). The opto-electronic module may be sandwiched between the cover sheet and the carrier to ensure that the module remain in place. The cover sheet may also be arranged to diffuse light emitted from the opto-electronic modules.

Further variations and advantages of this second aspect of the present invention are largely analogous to those provided in connection with the first aspect of the invention.

Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing currently preferred embodiments of the invention, wherein.

DETAILED DESCRIPTION OF AN EXAMPLE EMBODIMENT OF THE INVENTION

In the following description, the present invention is mainly described with reference to a lighting device comprising two carriers and opto-electronic modules in which the four contact points define a regular tetrahedron with at least two solid state-light sources.

It should, however, be noted that this by no means limits the scope of the invention, which is equally applicable to, for example, other arrangements of the light sources or other light sources than solid state light sources such as filament light sources. Furthermore, a configuration of light sources in the opto-electronic module may include other components such as semiconductor diodes or zener diodes.

Figure 1A:
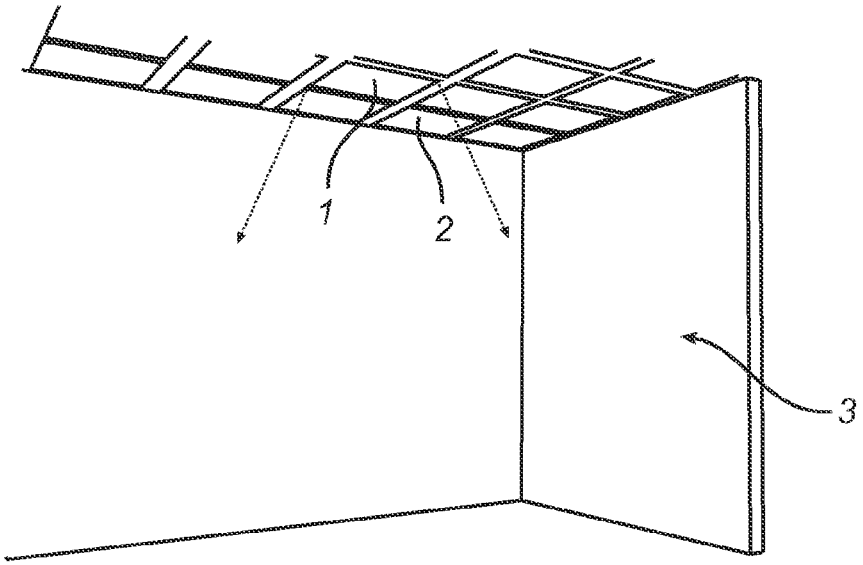
FIG. 1*a* schematically shows an exemplary application of the lighting device according to various embodiments of the present invention, in the form of a light-emitting panel arranged in a ceiling.

FIG. 1*a* schematically illustrates an exemplary application for embodiments of the lighting device according to the present invention, in the form of a light-emitting panel 1 arranged in a ceiling 2 of a room 3. The light-emitting panel 1 may be intended as daylight replacement and should then emit white light.

Figure 1B:
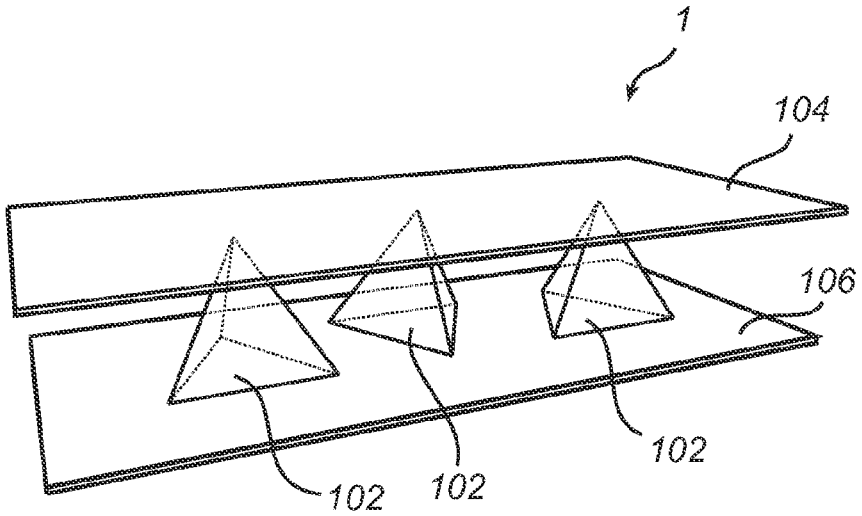
FIG. 1*b* is a schematic perspective view of the light-emitting panel in FIG. 1.

With reference to FIG. 1*b*, which is a perspective view of the light emitting panel in FIG. 1*a*, the light-emitting panel 1 comprises a cover sheet 104, a plurality of opto-electronic modules 102 and a carrier 106, such that the plurality of opto-electronic modules 102 are sandwiched between the cover sheet 104 and the carrier 106. The cover sheet 104 may be a translucent sheet arranged to diffuse the light emitted from the opto-electronic modules 102. Furthermore, the opto-electronic modules 102 may be organized in a more structured way to utilize the provided surface more efficiently for a brighter light emitting panel. For instance, the opto-electronic modules 102 may be placed close together in rows. Through the exemplary lighting device 1 in FIG. 1*a*, a relatively large area can be arranged to emit light. It should be noted that FIG. 1*b* is a simplified illustration of the light-emitting panel 1 in FIG. 1*a*, and that various structures, such as electrical connections to the opto-electronic modules 102 and structures for mounting the light-emitting panel 1 in the ceiling 2, are not explicitly indicated. Such structures can be provided in many different ways apparent to one skilled in the art.

Figure 2:
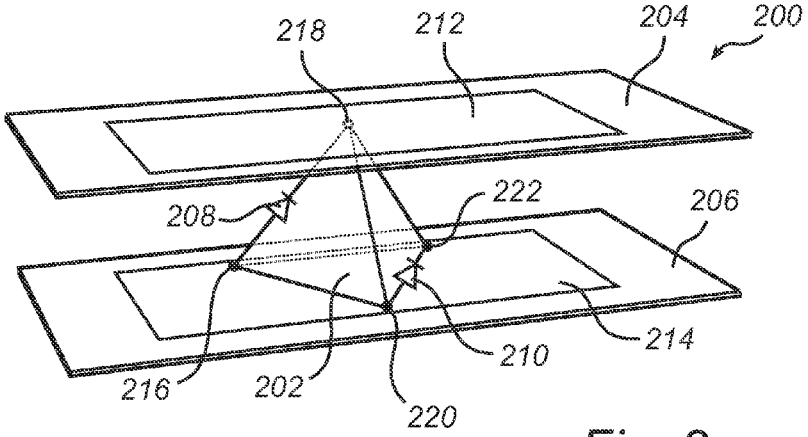
FIG. 2 is a perspective view of an embodiment of the lighting device comprising an opto-electronic module sandwiched between two electrodes.

With reference to FIG. 2, an embodiment of a lighting device will now be described in greater detail. In FIG. 2 a lighting device 200 is illustrated, having an opto-electronic module 202 arranged between a cover sheet 204 and a carrier 206. Moreover, a cover sheet electrode 212 is arranged between the opto-electronic module 202 and the cover sheet 204. Similarly, a first carrier electrode 214 is arranged between the opto-electronic module 202 and the carrier 206. The opto-electronic module 202 has four electric contact points 216, 218, 220, 222 arranged at corners of a regular tetrahedron. The opto-electronic module 202 comprises a first light source 208 and a second light source 210, here in the form of light emitting diodes. The first light source 208 is connected between a first electric contact point 216 and a second electric contact point 218 and the second light source 210 is connected between a third electric contact point 220 and a fourth electric contact point 222. The second electric contact point 218 is connected to the cover sheet electrode 212, while the first electric contact point 216, the third electric contact point 220 and the fourth electric contact point 222 are connected to the first carrier electrode 214. The arrangement of the light sources in the opto-electronic module, in FIG. 2, enables the first light source 208 to emit light when AC-voltage is applied between the electrodes 212, 214. At least one light source 208, 210 will emit light regardless of which one of the four faces of the tetrahedron defined by the electric contact points that will rest on the carrier electrode 214 if an AC-voltage is applied between the electrodes 212, 214.

Figure 3:
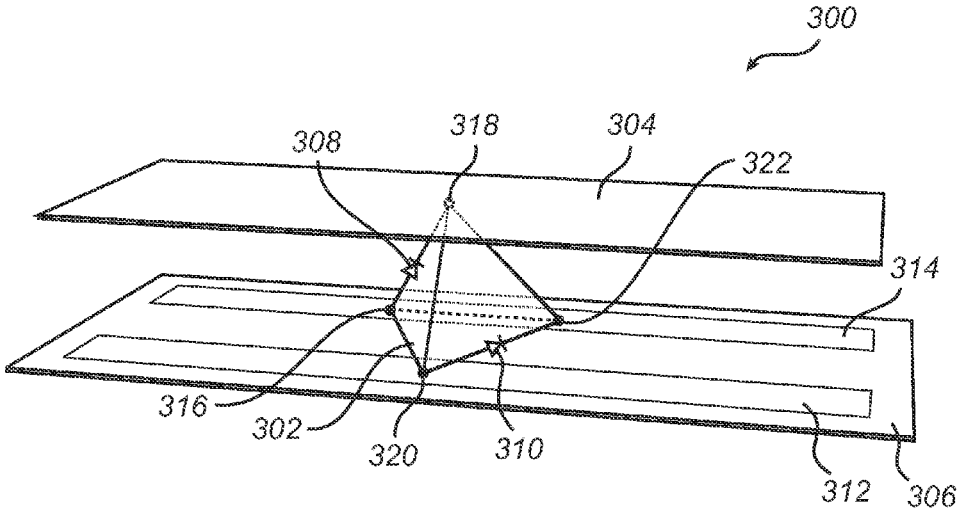
FIG. 3 is a perspective view of an embodiment of the lighting device comprising an opto-electronic module with two electrodes arranged on the carrier.

In FIG. 3, a lighting device 300, similar to the lighting device 200 in FIG. 2, is illustrated with the difference that the lighting device comprises a first carrier electrode 312 and a second carrier electrode 314 arranged on the side of the carrier 306 facing the opto-electronic module 302. An opto-electronic module 302 is sandwiched between a cover sheet 304 and a carrier 306. The cover sheet 304 is a diffused sheet allowing light from the opto-electronic module to be transmitted out to the surrounding. The first carrier electrode 312 and the second carrier electrode 314 are arranged on the carrier 306 such that the electrodes are arranged side-by-side. The third electric contact point 320 is connected to the first carrier electrode 312 and the first electric contact point 316 and fourth electric contact point 322 are connected to the second carrier electrode 314. The opto-electronic module 302 comprises a first solid state light source 308 and a second solid state light source 310. The first solid state light source 308 is attached to a first electric contact point 316 and a second electric contact point 318 and the second solid state light source 310 is attached to a third electric contact point 320 and a fourth electric contact point 322. The second solid state light source 310 is arranged to be illuminated when an AC-voltage is applied between the carrier electrodes 312, 314. One of the two light sources 308, 310 is arranged to emit light regardless of which of the four faces of the opto-electronic modules that lies against the carrier as long as the first electric contact point 316 and the second electric contact point 318 are in connected to separate electrodes 312, 314 or the third electric contact point 320 and the fourth electric contact point 322 are connected to separate electrodes 312, 314 when AC-voltage is applied. However, the lighting devices are not limited to be driven by AC-voltage. Alternatively, DC voltage may be used.

Figure 4:
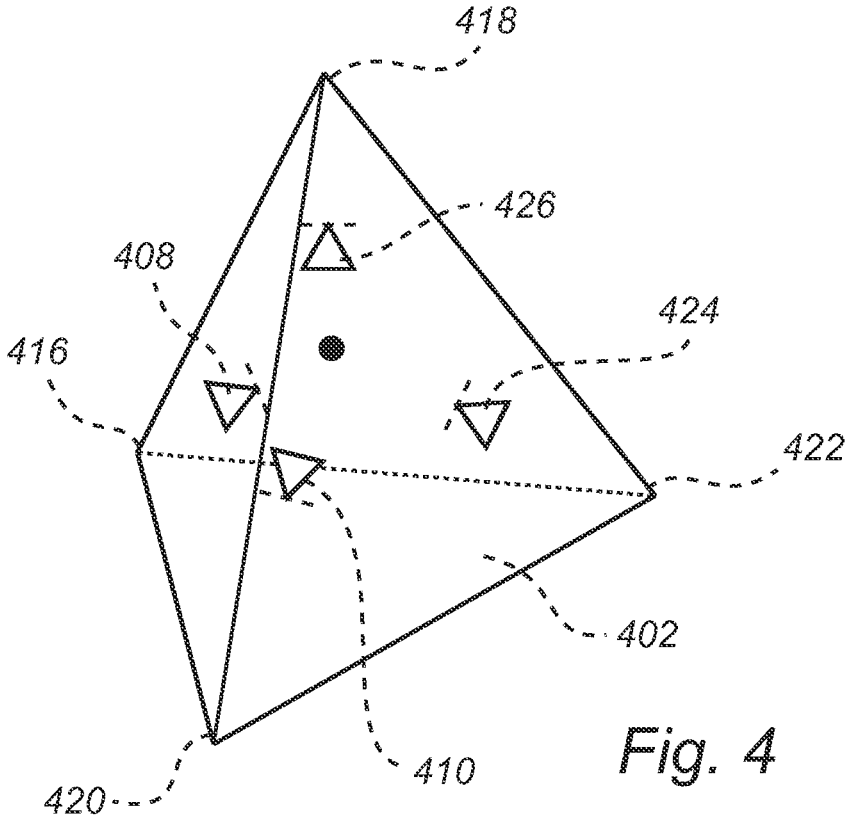
FIG. 4 is a perspective view of a type of opto-electronic module.
Figure 5:
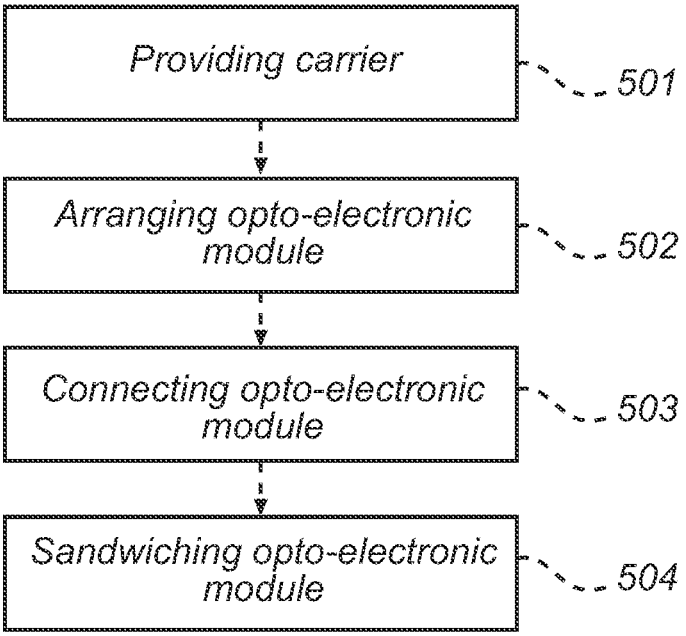
FIG. 5 is a flow-chart illustrating an exemplary manufacturing method according to an embodiment of the invention.

In FIG. 4, a opto-electronic module 402 is depicted with a first electric contact point 416, a second electric contact point 418, a third electric contact point 420, a fourth electric contact point 422 arranged as corners in a tetrahedron. The opto-electronic module 402 may replace the opto-electronic module 202 in FIG. 2 or the opto-electronic module presented in FIG. 3. The opto-electronic module 402 may emit light, when sandwiched between a first carrier electrode 214 and a cover sheet electrode 212, as in FIG. 2, or placed on a first carrier electrode 312 and a second carrier 314 electrode arranged on the side of the carrier 306 facing the opto-electronic module, as in FIG. 3. The contact points are connected with light sources, in this case light emitting diodes (LEDs). Each of the light emitting diodes is equipped with an anode and a cathode. An anode of the first light source 408 is connected to the first electric contact point 416, the cathode of the second light source 410 is connected to the third electric contact point 420, the cathode of the third light source 426 is connected to the second electric contact point 418 and the anode of the fourth light source 424 is connected the fourth electric contact point 422. Furthermore, the cathode of the first light source 408, the anode of the second light source 410, the anode of the third light source 426 and the cathode of the fourth light source 424 are connected to each other. Three out of four light sources will emit light when the opto-electronic module 402 is sandwiched between two electrodes and AC-voltage is applied. When the first electric contact point 416 experiences a higher voltage than the second 418, third 420 and fourth 422 electric contact points, the first light emitting diode 408 is able to transfer current from the anode to the cathode. Since the direction of the anode and the cathode of the second light emitting diode 410 and the third light emitting diode 426 follows the potential drop both these light sources will be able to transfer current. However, the fourth light emitting diode 424 is arranged in the reverse bias direction with regard to the potential drop over the fourth light emitting diode 424. Thus, the fourth light emitting diode 424 will not emit light for this configuration. The three other light emitting diodes will however emit light. Different light sources will light up depending on the orientation of the opto-electronic module and the sign of the potential experienced by the electric contact points.

In the case where the first, second, third and fourth light source are differently colored light emitting diodes, the forward threshold voltage may be different for each of the four light sources. As an example, the first light source may be a LED (light emitting diode) emitting red light at 1.6-1.8 V, while the second light source may be a LED emitting green light at 2.2-2.4 V. Further, the third light source may for example be a blue LED run at 3.0-3.1V and the fourth light source may be a white conversion LED emitting light at 3.0-3.1 V. The first light source may be connected in series with two Si diodes while the second light source may be connected in series to one Si diode to balance the difference in forward threshold voltage for the different light sources. The Si diode has a forward threshold voltage of ~0.7 V. However, other diodes and light sources may be used. Alternatively, the first light source emitting red light may be connected in series to an additional LED emitting red light to yield 3.2-3.4 V, while connecting the third light source in series with a Germanium diode. Alternatively, the first light source may be connected in series with two other LEDs emitting red light to yield 4.8 V. The second light source may be connected in series with an additional LED emitting green light to also yield 4.8V, while the third and the fourth light sources are each connected in series with a 1.8 V zener diode. Each of the light sources may separately or in combination with a series connected diode(s) be adjusted to a predetermined voltage. The predetermined voltage may for example be set to the value of the threshold voltage for the light source with the highest threshold voltage.

Finally, an exemplary method of manufacturing the lighting device according to an embodiment of the invention is presented.

In a first step 500, a carrier 106, 206, 306 is provided.

In a next step 501, a plurality of opto-electronic modules 102, 202, 302, 402 are arranged on said carrier 106, 206, 306.

In step 503, the opto-electronic modules 102, 202, 302, 402 are connected to an electrode pattern being configured to allow application of an AC-voltage between the first electric contact point 216, 316, 416 and the second electric contact point 218, 318, 418 or the third electric contact point 220, 320, 420 and the fourth electric contact point 222, 322, 422.

In step 504, the plurality of opto-electronic modules 102, 202, 302, 402 is sandwiched between the carrier 106, 206, 306 and the cover sheet 104, 204, 304. In this case, the electrode pattern comprises a cover sheet electrode 212 and a first carrier electrode 214, 312. The cover sheet electrode 212 is arranged on said cover sheet 104, 204, 304 such that the cover sheet electrode 212 faces the opto-electronic module 102, 202, 302, 402 and the first carrier electrode 214, 312 facing towards the opto-electronic module 102, 202, 302, 402 is arranged on the carrier 106, 206, 306. The opto-electronic modules 102, 202, 302, 402 may be placed on the carrier 106, 206, 306 e.g. uniformly or in a pattern. The opto-electronic module 102, 202, 302, 402 may be arranged onto the carrier 106, 206, 306 without regard of the orientation of the module, as long as an AC-voltage may be arranged to be applied between the first electric contact point 216, 316, 413 and the second electric contact point 218, 318, 418or between the third electric contact point 220, 320, 420 and the fourth electric contact point 222, 322, 422. The placed opto-electronic module 102, 202, 302, 402 is supported and stabilized by three electric contact points resting against the carrier. The shape and structure of the opto-electronic module and the arrangement of the light sources enable the opto-electronic module(s) 102, 202, 302, 402 to be placed onto a faster moving carrier 106, 206, 306.

The cover sheet electrode 212 may be a wire-mesh electrode including metal wires, metal curls or metal sheet with holes. The electric contact point connected to the cover sheet electrode may be fixated by pressure fixation. For example, an external binder may be used to clamp electric contact point to the cover sheet electrode. Alternatively, soldering and/or curable conductive adhesives may also be used. For soldering, the opto-electronic module(s) may be pre-equipped with a solder at each electric contact point.

The production line may involve different in-line stations such as applying an electrode pattern with an electrode patterning machine, a solder dispenser supplying solder such that the electric contact points of the opto-electronic modules may be soldered to the electrode pattern by providing heat from a soldering oven arranged as a station in the production line. For example, conductive, insulating, transparent, opaque, patterned and/or un-patterned carriers may be used. The opto-electronic modules may be placed on the carrier through stationary or moving units, which may comprise at least one of a dispersing slit, tube and/or funnels. The opto-electronic module may further be fixated to the electrode pattern through a fixation unit, which may further improve the electrical connection between the electric contact points and the electrodes. The fixation unit may for example be a solder oven, a hot-air blade or knife, inductive heaters or soldering waves to liquefy a soldering material around connection between the electric contact points of the opto-electronic module(s) and the electrode pattern. Alternatively, a pressure sensitive adhesive or a thermo-sonic bonder may be used. For example the pressure sensitive adhesive may be filled with metal particles. Alternatively, an insulating carrier may be pre-coated with a thermosetting composite material such that if the opto-electronic module(s) is dropped onto the carrier the module(s) may be fixated through curing the thermosetting composite material. The thermosetting composite material may further be resistive.

Furthermore, a protective coating may be applied from a protective coating unit. Furthermore, for a patterned and opaque carrier a reflective surface coating may be applied. For example, electrophoretic deposition such as a cataphoretic coating may be applied to the lighting device 1. Another alternative may be an electrostatic coating. The opto-electronic module(s) may further be made of a non-wetting material.

In the case of a patterned carrier at least two drive electrodes may be provided.

The opto-electronic module may comprise a first, a second, a third and a fourth surface, wherein each of the surfaces are provided with a pattern in surface topography. The opto-electronic modules may comprise a transparent or a translucent material arranged within the tetrahedron shape defined by the electric contact points. The surface of the opto-electronic module can be made concave or convex. Alternatively, the surfaces may be arranged with a sine wave pattern, a zigzag pattern, a square wave pattern or a saw-tooth pattern to reduce the risk of opto-electronic module sticking together. Alternatively, the surface faces may be made of or post-treated with a material that acquires an electrostatic surface charge, such that the surfaces of the opto-electronic modules repel each other.

Additionally, variation to the disclosed embodiments can be understood and effected by the skilled person in practicing the claimed invention, from a study of the drawings, the disclosure, and the appended claims. In the claims, the word "comprising" does not exclude other elements or steps and the indefinite article "a" or "an" does not exclude a plurality. The mere fact that certain measures are recited in mutually different dependent claims does not indicate that a combination of these measured cannot be used to advantage.

The invention claimed is:

1. A lighting device comprising:

a carrier;

an electrode pattern comprising at least a first carrier electrode arranged on said carrier; and an opto-electronic module, wherein the opto-electronic module comprises:

a first, a second, a third and a fourth electric contact point arranged to together define a tetrahedron;

a first light source arranged to emit light in response to voltage being applied between the first electric contact point and the second electric contact point;

a second light source arranged to emit light in response to a voltage being applied between the third electric contact point and the fourth electric contact point, wherein the electrode pattern is configured to allow provision of voltage between the first electric contact point and the second electric contact point or between the third electric contact point and the fourth electric contact point of the opto-electronic module.

2. The lighting device according to claim 1, comprising a plurality of opto-electronic modules.

3. The lighting device according to claim 1, wherein the first light source has a first terminal connected to the first electric contact point and a second terminal connected to the second electric contact point, and wherein then second light source has a first terminal connected to the third electric contact point and a second terminal connected to the fourth electric contact point.

4. The lighting device according to claim 1, further comprising a cover sheet, wherein the opto-electronic module is sandwiched between the carrier and the cover sheet.

5. The lighting device according to claim 4, wherein the electrode pattern comprises a cover sheet electrode arranged on the cover sheet, the cover sheet electrode being in electrical contact with at least one of the first, second, third and fourth contact points of the opto-electronic module.

6. The lighting device according to claim 5, wherein three of the first electric contact point, the second electric contact point, the third electric contact point and the fourth electric contact point are in connection with the first carrier electrode and one of the first electric contact point, the second electric contact point, the third electric contact point and the fourth electric contact point is in connection with the cover sheet electrode.

7. The lighting device according to claim 6, wherein each of the first light source and the second light source comprises an anode and a cathode, wherein the opto-electronic module further comprises a third light source and a fourth light-source, each comprising an anode and a cathode, and wherein:

the anode of the first light source is connected to the first electric contact point;

the cathode of the second light source is connected to the third electric contact point;

the cathode of the third light source is connected to the second electric contact point;

the anode of the fourth light source is connected to the fourth electric contact point; and the cathode of the first light source, the anode of the second light-source, the anode of the third light source, and the cathode of the fourth light source are connected to each other.

8. The lighting device according to claim 7, wherein the electrode pattern further comprises a second carrier electrode arranged on the carrier.

9. The lighting device according to claim 8, wherein the opto-electronic module comprises a diffuser material arranged within the tetrahedron defined by the first electric contact point, the second electric contact point, the third electric contact point and the fourth electric contact point to scatter light emitted by the light sources.

10. The lighting device according to claim 9, further comprising a sound absorbing material.

11. The lighting device according to claim 10, wherein each of the light sources is a solid state light source.

12. The lighting device according to claim 11, wherein the opto-electronic module comprises at least one regular diode.

13. The lighting device according to claim 12, wherein the electrode pattern comprises at least one of a resistive electrode, a transparent electrode and a reflective opaque electrode.

14. A method for manufacturing a lighting device comprising the steps of:

providing a carrier;

arranging at least one opto-electronic module on the carrier, wherein the opto-electronic module comprises:

a first, a second, a third and a fourth electric contact point arranged to together define a tetrahedron;

a first light source arranged to emit light in response to voltage being applied between the first electric contact point and the second electric contact point; and a second light source arranged to emit light in response to applied between the third electric contact point and the fourth electric contact point; and connecting the at least one opto-electronic module to an electrode pattern being configured to allow application of voltage between the first electric contact point and the second electric contact point or between the third electric contact point and the fourth electric contact point.

15. The method according to claim 14, further comprising the step of:

disposing said at least one opto-electronic module between said carrier and a cover sheet.

* * * * *